US006192720B1

(12) United States Patent
Kan

(10) Patent No.: US 6,192,720 B1
(45) Date of Patent: Feb. 27, 2001

(54) LOCKING STRUCTURE

(76) Inventor: Fu-Ben Kan, 12-1F., No. 112, Sec. 2, Chung-Shan N. Rd., Taipei (TW)

( * ) Notice: Subject to any disclaimer, the term of this patent is extended or adjusted under 35 U.S.C. 154(b) by 0 days.

(21) Appl. No.: 09/258,124

(22) Filed: Feb. 26, 1999

(51) Int. Cl.[7] ..... E05B 67/06
(52) U.S. Cl. ..... 70/49
(58) Field of Search ..... 70/14, 18, 30, 70/49, 58, 233, 38 A

(56) References Cited

U.S. PATENT DOCUMENTS 3,950,972 * 4/1976 Bleier et al. ..... 70/49 X
4,033,160 * 7/1977 Mima ..... 70/233
4,037,441 * 7/1977 Ray ..... 70/233
4,044,577 * 8/1977 Horlacher ..... 70/49 X
4,086,795 * 5/1978 Foster et al. ..... 70/49 X
4,543,806 * 10/1985 Papandrea et al. ..... 70/30
4,676,080 * 6/1987 Schwarz ..... 70/49 X
5,009,087 * 4/1991 Long ..... 70/49
5,144,821 * 9/1992 Ernesti et al. ..... 70/49 X
5,156,028 * 10/1992 Jiang ..... 70/233 X
5,408,212 * 4/1995 Meyers et al. ..... 70/233 X
5,473,917 * 12/1995 Say ..... 70/49
5,706,679 * 1/1998 Zane et al. ..... 70/233 X
5,768,920 * 6/1998 DeBevoise et al. ..... 70/233 X

* cited by examiner

*Primary Examiner*—Suzanne Dino Barrett
(74) *Attorney, Agent, or Firm*—Dougherty & Troxell

(57) ABSTRACT

The present creation is focused on providing structural improvements to the locking device by pivotable installing a windlass in the interior body of the lock for winding the steel cable, also installed at one lateral side is a single-direction ratchet gear, with a rotary spring bent at another lateral side to drive the windlass, and a stopper of the locking mechanism controlled by the core of the locking device set at one lateral side of the windlass to cope with a compressed spring; a tenon and mortise are fixed onto the stopper corresponding to the single-direction ratchet gear, and at the end of the steel cable a ring is used to connect it with the locking pin on the steel cable or at the extreme end of the U-shape rod. When the locking pin is locked together with the body of the locking device, the safety helmet and other articles can then be locked firmly.

1 Claim, 4 Drawing Sheets

LOCKING STRUCTURE

BACKGROUND OF THE INVENTION a. Field of the Invention

The present invention related to the structural improvement of a locking device, particularly denoting a locking device structure attached to the body of a steel cable lock or a U-shape lock used for locking a safety cap or other articles which are not of a portable nature, wherein a windlass is fixed in the interior body of the locking device for winding the cable, also fixed at one lateral side is a single-direction ratchet gear, and a rotary spring is curved at another lateral side to drive the windlass, and a stopper of the locking mechanism controlled by the core of the locking device is fixed at one lateral side of the windlass to cope with a compressed spring; a tenon and mortise are fixed onto the stopper corresponding to the single-direction ratchet gear, and at the end of the cable a ring is used to engage with the locking pin at the cable or at the extreme end of the U-shape rod. The locking structure disclosed herein is so designed that after pulling the ring, pass it through the safety helmet to engage with the locking pin on the cable or at the extreme end of the U-shape rod. When the locking pin is locked together with the body the locking deviced, the safety helmet and the other articles can then be locked firmly.

b. Description of the Prior Art

A motorcyclist or a person who rides a bicycle has to wear a safety helmet to ensure safety. However, unlike a motorcar, no baggage compartment is available in a motorcycle or a bicycle to provide a space for keeping the safety helmet, which is found to be considerably large in dimension that makes portability uneasy. Therefore, many motorcyclists or riders have to put their safety helmet onto their motorcycles or bicycles or simply hang them on the handles of their motorcycles or bicycles, and often caused their safety helmets easily stolen.

Furthermore, the main objective of the U-shape rod or cable locking device used for locking motorcycles or bicycles is, after passing the U-shape rod or steel cable through the wheel of the motor-cycle or bicycle, to lock the pin of the U-shape rod or the pin at the end of a cable onto the body of the locking device, and thus ensure that the wheel is locked securely against stealing. However, the lock of such a locking mechanism does not provide any structure for locking a safety helmet.

SUMMARY OF THE INVENTION

Therefore, the main objective of the present invention is to provide a locking device which is attached onto the body of a cable locking device or a U-shape rod locking device for locking a safety helmet or other articles which are inconvenient for carrying, wherein a windlass is fixed in the interior body of the locking device for winding the steel cable, also fixed at one lateral side is a single-direction ratchet gear, and a rotary spring is bent at another lateral side to drive the windlass, and a stopper of the locking mechanism controlled by the core of the locking device is set at one lateral side of the windlass to cope with a compressed spring; a tenon and mortise are fixed onto the stopper corresponding to the single-direction ratchet gear, and at the end of the cable a ring is used to connect with the locking pin on the steel cable or at the extreme end of the U-shape rod. The locking structure disclosed herein is so designed that after pulling the ring, pass it through the safety helmet to connect with the locking pin on the cable or set at the extreme end of the U-shape rod. When the locking pin is locked together with the body the locking deviced, the safety helmet and the other articles can then be locked firmly.

The other objectives and detailed structure of the present invention will become clear by referring to the illustrations and drawings which are set below:

DESCRIPTION OF THE PREFERRED EMBODIMENT

Figure 1:
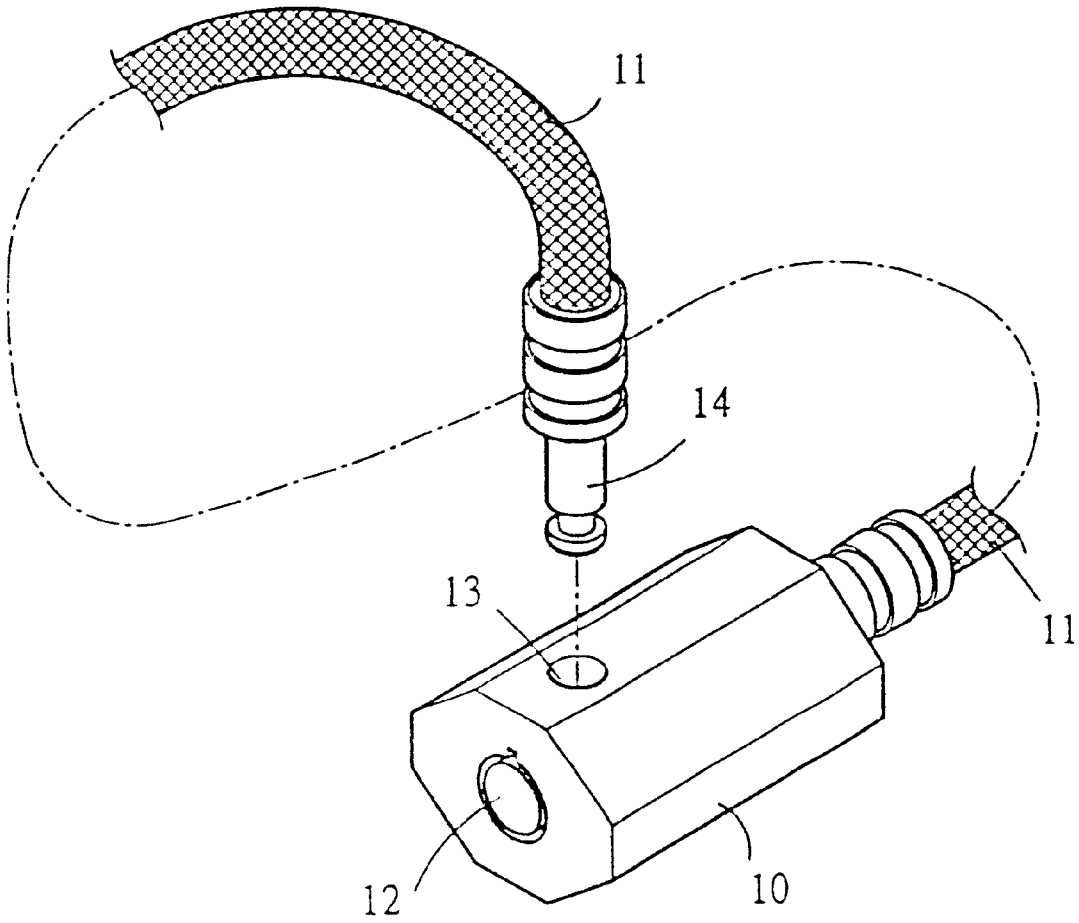
FIG. 1 is a pictorial indicative drawing of a traditional steel cable locking device.

As indicated in FIG. 1, a conventional steel cable locking device for locking a motor-cycle or bicycle comprises of the body of a locking device 10, and cable 11 which is integrally formed with the body of a locking device 10, in which locking core 12 is fixed in the interior of body of the locking device 10, and on the body of locking device 10 is hole 13 which pierced through locking core 12, and at the extreme end of steel cable 11 locking pin 14 is connected to pierce through hole 13 until it reached locking core 12; after connecting locking pin 14 at the extreme end of cable 11 for piercing through and inserting into hole 13, and the interference exerted by locking core 12, locking pin 14 will be securely locked in the interior of hole 13. Upon the utilization of the locking structure mentioned herein, cable 11 is wound into the front fork or the rear fork of the wheel of a motor-cycle or bicycle, and then lock it securely by inserting locking pin 14 into the interior of hole 13. Alternatively, locking can also be made by directly winding a motorcycle or bicycle onto any fixture nearby to achieve the objective of anti-theft.

The "improvement of locking structure" disclosed in the present invention is something connecting with the interior of the above-mentioned body of locking device 10, after implementation is made in association with the locking pin, it will lock the safety helmet of the any other articles which are inconvenient for carrying.

Figure 2:
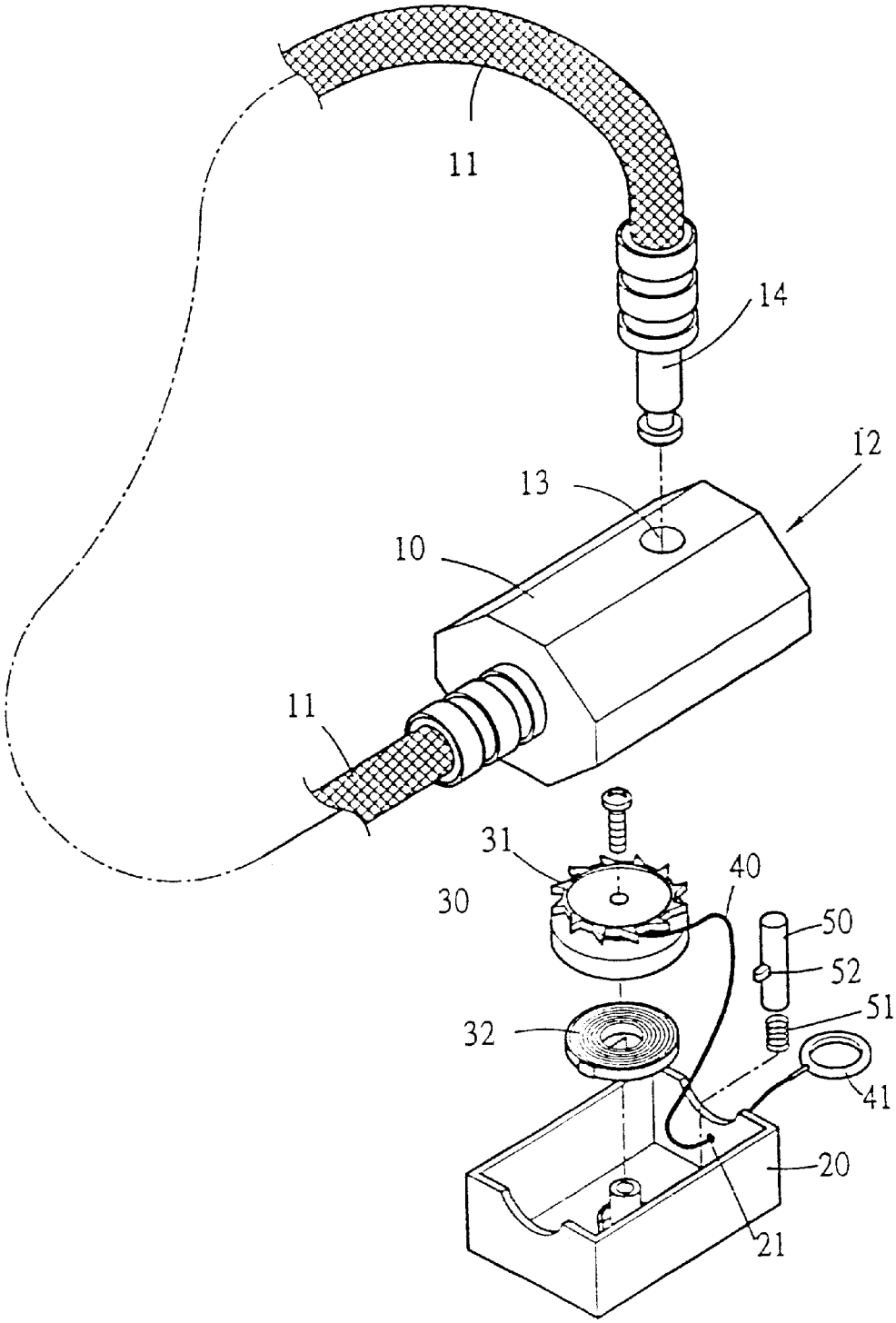
FIG. 2 is a pitorial segmentation drawing of the present invention.
Figure 3:
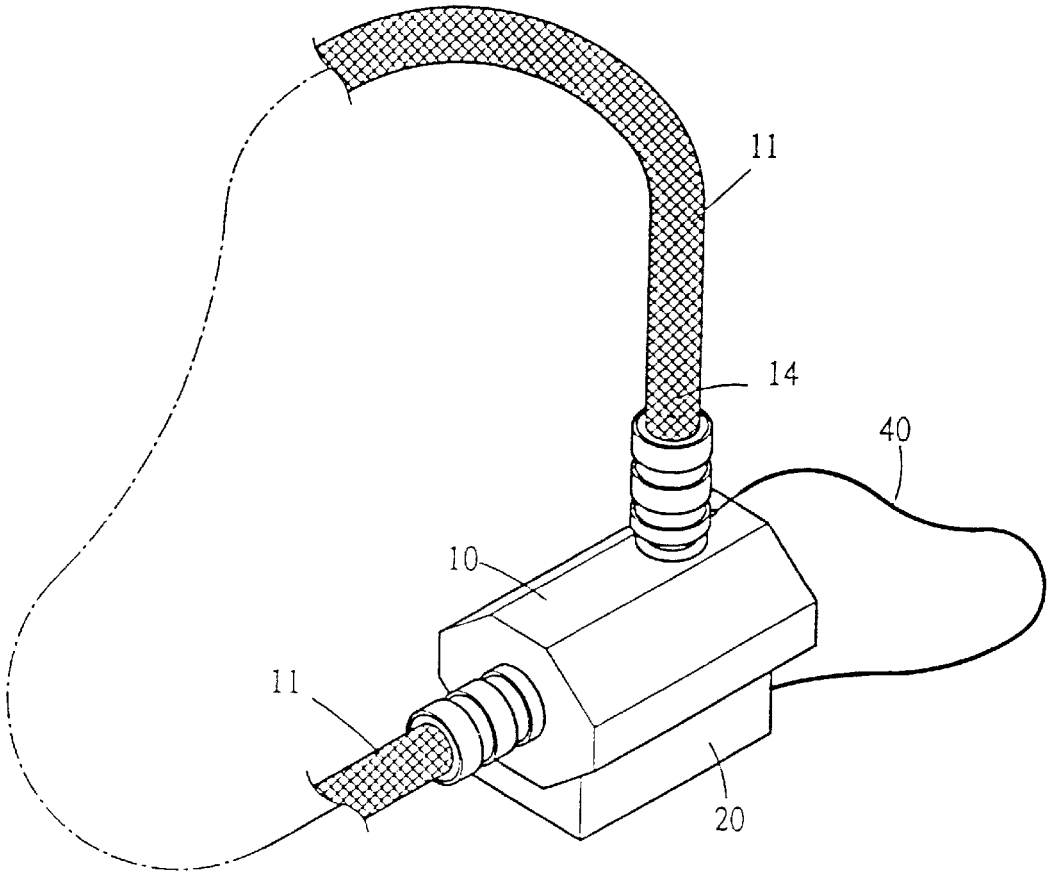
FIG. 3 is a pictorial assembling drawing of the present invention.
Figure 4:
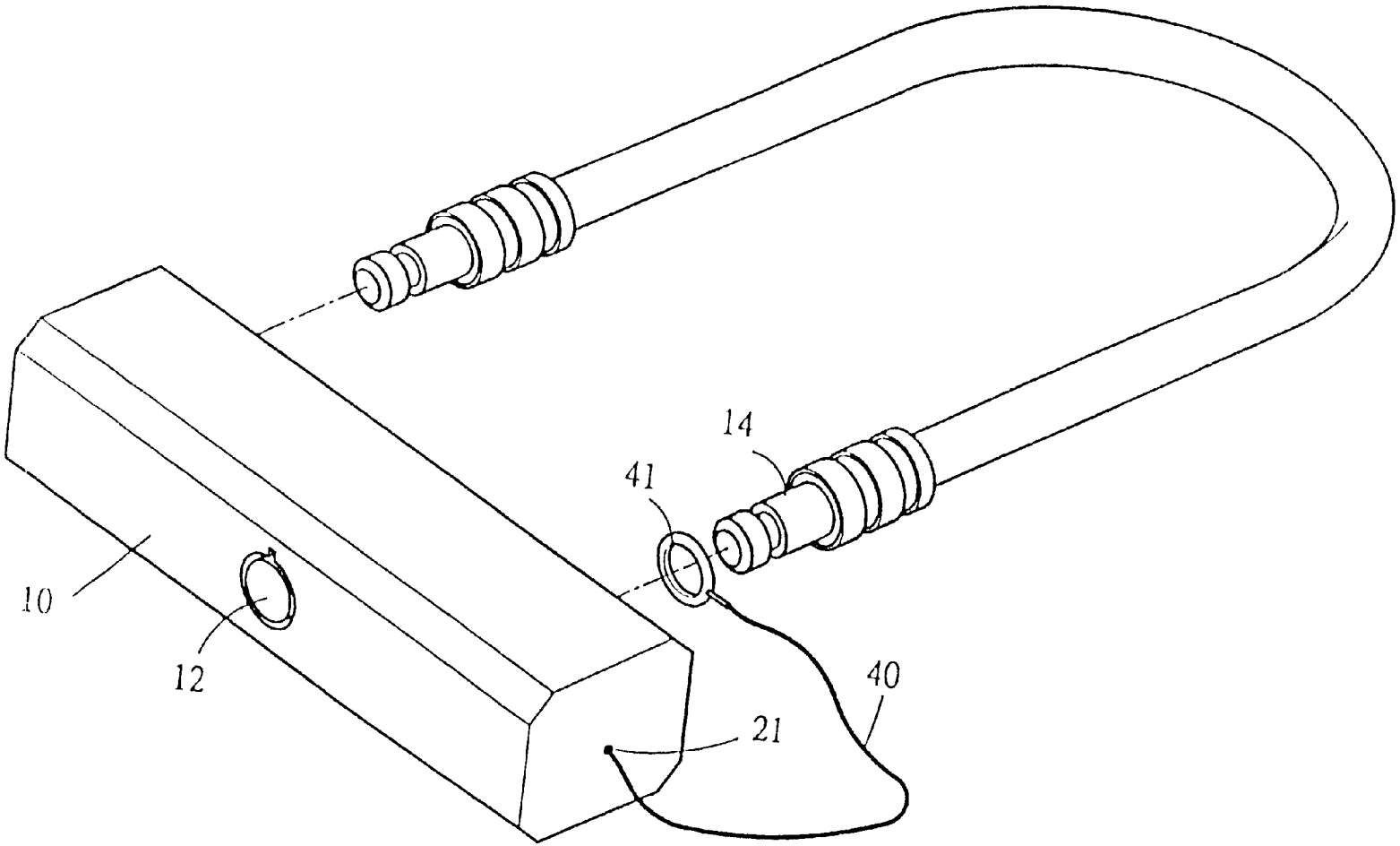
FIG. 4 is a preferred embodiment of the present drawing.

As indicated in FIG. 2, the present invention comprises of shell body 20 which is integrally formed with a locking device, and windlass 30 for winding steel cable 40 is pivotally fixed in the interior of shell body 20, at the lateral side of which is a single-direction ratchet gear 31, while at the other lateral side is a curved rotary spring 32 to exert a force of motion to rotate windlass 30; there is another stopper 50 which is controlled by the locking core 12 of the body of the locking device operating in coordination with compressed spring 51 fixed at the lateral side of windlass 30, and a tenon and mortise 52 is fixed on stopper 50 corresponding with single-direction ratchet 31, and ring 41 is connected to the extreme end of cable 40 to engage with locking pin 14 at the extreme end of cable 11.

The relative relationship between the aforementioned windlass 30 and stopper 50 is so defined that by means of the engagement of stopper 52 with the aforementioned single-direction ratchet gear 31, windlass 30 will be restricted to the extent of driving such single direction rotation as winding cable 40, and further by means of the control exerted by locking core 12 on the body of locking device 10 to enable stopper 52 to break away from its engagement with single direction ratchet gear 31, so as to enable windlass 30 to conduct a dual-direction rotation, and thus enable cable 40 to extend outward or by means of the dynamic force generated by rotary spring 32 to cause windlass 30 to rotate and wind the steel cable.

In practice, the present invention is to pass ring 41 through the safety helmet after it is pulled out, so that it will engage with locking pin 14 at the extreme end of cable 11. When locking pin 14 and the body of locking device 10 is securely locked, the safety helmet and other articles will be securely locked. Due to the dynamic force generated by rotary spring 32, after the user has released the cable, windlass 30 will start to collect cable 40, and thus will tighten up the safety helmet and other articles, and also fix the articles firmly with the association of stopper 52 and single-direction ratchet gear 31 without loosening the locking thus made.

As indicated by Fig, 4, the present invention is not confined to being applied to a cable locking device, it is also applicable to a U-shape rod locking device, and its structure and principle are similar to those of the aforementioned cable locking device.

Summarizing the above, the structure of "the structural improvement of locking device" disclosed herewith in the present invention proved to be simple and unique, convenient for utilization, capable of preventing safety helmets and other articles from being stolen, and is gifted with practicality and advancement. Therefore, the structural features of the present invention are found coincide with the essential requirements for patent application, and an application is hereby filed with the patent office, for which your kind consideration and approval would be very much appreciated.

What is claimed is:

1. A locking device comprising:

a body having a hole;

a locking core fixed within interior of said body;

a steel cable having a first end fixedly connected with said body and a second end provided with a locking pin configured to engage with said locking core through said hole;

a rectangular shell body integrally formed with said body;

a windlass pivotally mounted in said rectangular shell body;

a single-direction ratchet gear mounted on one side of said windlass;

a rotary spring mounted on another side of said windlass to urge said windlass to rotate;

a stopper urged by a spring to engage with said locking core and having a projection engaged with said ratchet gear;

a winding cable having a first end fixedly connected with said windlass and a second end extending through said shell body to engage with a ring;

whereby when in use, said ring is pulled out of said shell body to bind a desired article and engaged with said locking pin and then said locking pin is inserted in said hole to engage with said locking core, thus securely locking said article in place.

* * * * *